US009680238B1

(12) United States Patent
Otsuba

(10) Patent No.: US 9,680,238 B1
(45) Date of Patent: Jun. 13, 2017

(54) VERTICAL MOUNT BATTERY FUSER TERMINAL

(71) Applicant: Sumitomo Wiring Systems, Ltd., Yokkaichi, Mie (JP)

(72) Inventor: Kazuto Otsuba, Marysville, OH (US)

(73) Assignee: Sumitomo Wiring Systems, Ltd., Yokkaichi, Mie (JP)

( * ) Notice: Subject to any disclaimer, the term of this patent is extended or adjusted under 35 U.S.C. 154(b) by 0 days.

(21) Appl. No.: 15/361,941

(22) Filed: Nov. 28, 2016

(51) Int. Cl.

| | |
|---|---|
| ***H01R 11/26*** | (2006.01) |
| ***H01R 4/50*** | (2006.01) |
| ***H01R 4/26*** | (2006.01) |
| *H01R 101/00* | (2006.01) |

(52) U.S. Cl.
CPC ..... *H01R 4/5091* (2013.01); *H01R 4/26* (2013.01); *H01R 2101/00* (2013.01)

(58) Field of Classification Search
CPC ..... H01R 11/283
USPC ..... 439/762, 770, 774
See application file for complete search history.

(56) References Cited

U.S. PATENT DOCUMENTS

| | | | | |
|---|---|---|---|---|
| 1,746,514 | A * | 2/1930 | Baunach | H01R 11/283 439/762 |
| 5,302,143 | A * | 4/1994 | Inoue | H01R 11/283 439/762 |
| 5,454,741 | A * | 10/1995 | Okada | H01R 11/283 439/762 |
| 5,547,403 | A * | 8/1996 | Haberstroh | H01R 11/283 439/762 |
| 9,472,870 | B2 * | 10/2016 | Shonts | H01R 11/289 |
| 9,590,325 | B2 * | 3/2017 | Tanigawa | H01R 11/283 |
| 9,608,254 | B1 * | 3/2017 | Freitag | H01M 2/307 |

FOREIGN PATENT DOCUMENTS

| | | |
|---|---|---|
| JP | 11026054 | 7/1999 |
| JP | 2003187784 A | 7/2003 |
| JP | 2010092697 A | 4/2010 |

* cited by examiner

*Primary Examiner* — Neil Abrams
(74) *Attorney, Agent, or Firm* — Dinsmore & Shohl LLP

(57) ABSTRACT

A vertical mounted battery terminal mounting assembly includes a battery having a terminal post. A post attachment structure including a contact portion shaped to engage the terminal post of the battery is provided. The post attachment structure includes a wedge translation portion having an angled slide surface. An internal wedge is positioned within the post attachment structure. The internal wedge includes an angled wall and terminal contacts. A core bolt is rotationally fixed and extends through the post attachment structure and the internal wedge. A nut is threaded on the core bolt and contacts an upper edge of the internal wedge wherein the angled wall of the internal wedge engages the angled slide surface of the post attachment structure. Rotation of the nut imparts a downward force on the internal wedge wherein contact of the angled wall and the slide surface evenly translates the downward force to a horizontal force wherein the terminal contacts and the contact portion engage the battery terminal post.

20 Claims, 6 Drawing Sheets

VERTICAL MOUNT BATTERY FUSER TERMINAL

FIELD OF THE INVENTION

The invention relates to vertically mounted battery terminal mounting structures for attaching to a battery terminal.

BACKGROUND OF THE INVENTION

Current prior art battery connections may include various layouts or structures to attach to a battery terminal post. For example, horizontal and diagonal bolt assemblies may be coupled to a clamp to tighten the clamp about the terminal post. Such structures may have the problem of uneven attachment forces being applied to the clamp allowing the connection to come loose from a battery post. Further, such prior art battery connections may have limitations due to the shape of the structures. For example, batteries may include various walls, covers or other surfaces in proximity to the battery post that limit the accessibility of a tool to tighten the bolt of prior art structures.

Additionally, battery type connections may include vertical bolt assembly type mechanisms. In such assemblies, a clamping band may be positioned about the battery post with one side of the band being fixed relative to a component and the other side being movable by translation of a nut or post to apply a clamping force about the band. Such assemblies are complicated and do not adequately transfer an equal force about the band attached to the battery post.

Further designs may include multiple wedge blocks that are translated against each other to apply a clamping force about a clamp which is positioned around the terminal post. Again, such designs may lead to inadequate translation of a force from the nut torque to the clamping mechanism positioned around the battery post such that an inadequate amount of clamping force is provided. Further, such mechanisms may include multiple components resulting in a complicated assembly process and an increased part cost.

There is therefore a need in the art for an improved battery terminal connection assembly that may be mounted vertically and may attach additional components to the battery post. There is also a need in the art for an improved vertically mounted terminal mounting assembly that has a limited number of components and is easy to assemble for various types of batteries. There is also a need in the art for a vertically mounted battery terminal mounting assembly that has a small footprint and does not block easy connection of the component to a battery post for various types of batteries including batteries positioned in a relatively restricted space.

SUMMARY OF THE INVENTION

In one aspect there is disclosed a vertical mounted battery terminal mounting assembly that includes a battery having a terminal post. A post attachment structure including a contact portion is formed with a wedge translation portion. The contact portion is shaped to surround the terminal of the battery. The wedge translation portion includes opposing walls joined at an angled slide surface. An internal wedge is positioned within the terminal post structure. The internal wedge includes an u-shaped body having opposing side walls coupled by an angled wall. The opposing walls include terminal contacts extending therefrom. A core bolt is rotationally fixed and extends through the post attachment structure and extends in a cavity defined by the separated opposing side walls of the internal wedge. A nut is threaded on the core bolt and contacts an upper edge of the internal wedge. The angled wall of the internal wedge engages the angled slide surface of the post attachment structure wherein rotation of the nut imparts a downward force on the internal wedge wherein contact of the angled wall and the slide surface evenly translates the downward force to a horizontal force moving the terminal contacts into engagement with the terminal post.

In another aspect, there is disclosed a vertical mounted battery terminal mounting assembly including a battery having a terminal post. The mounting structure includes a post attachment structure including a contact portion shaped to engage the terminal post of the battery. The post attachment structure includes a wedge translation portion having an angled slide surface. An internal wedge is positioned within the post attachment structure. The internal wedge includes an angled wall and terminal contacts. A core bolt is rotationally fixed and extends through the post attachment structure and the internal wedge. A nut is threaded on the core bolt and contacts an upper edge of the internal wedge wherein the angled wall of the internal wedge engages the angled slide surface of the post attachment structure. Rotation of the nut imparts a downward force on the internal wedge wherein contact of the angled wall and the slide surface evenly translates the downward force to a horizontal force wherein the terminal contacts and the contact portion engage the battery terminal post.

DETAILED DESCRIPTION OF THE EMBODIMENTS

Referring to FIGS. 1-12 there is detailed a vertical mounted battery terminal mounting assembly 20 for attaching to a battery 22. In one aspect, the battery 22 includes a terminal post 24.

Figure 1:
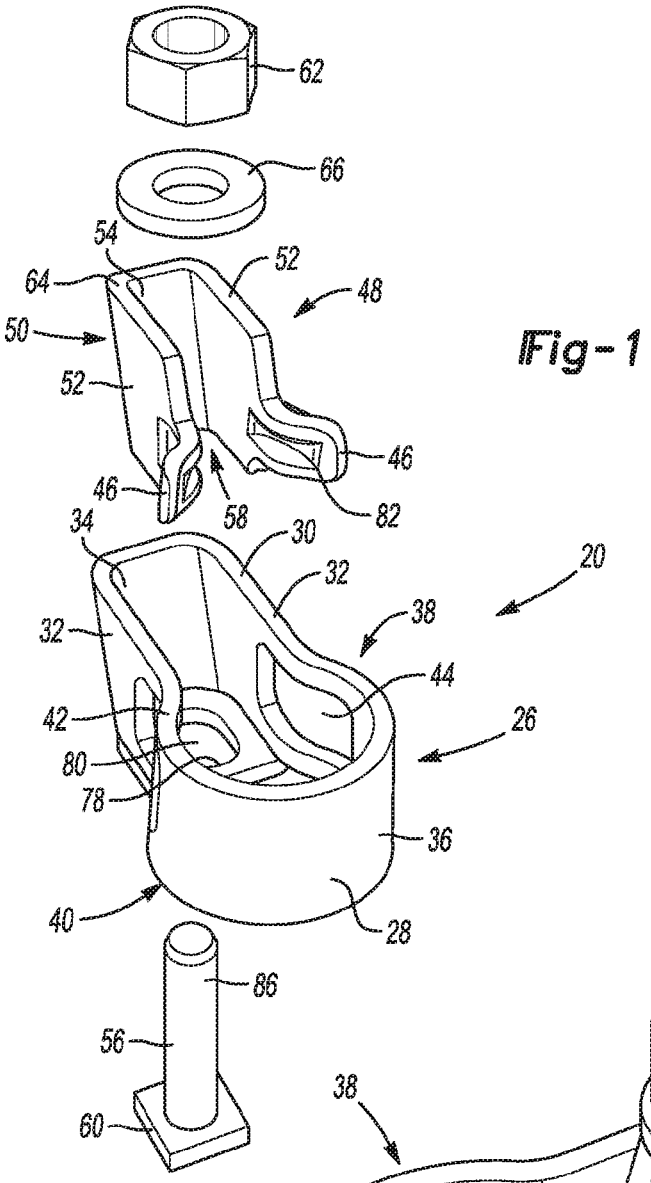
FIG. 1 is an exploded perspective view of a vertical mounted battery terminal mounting assembly.
Figure 2:
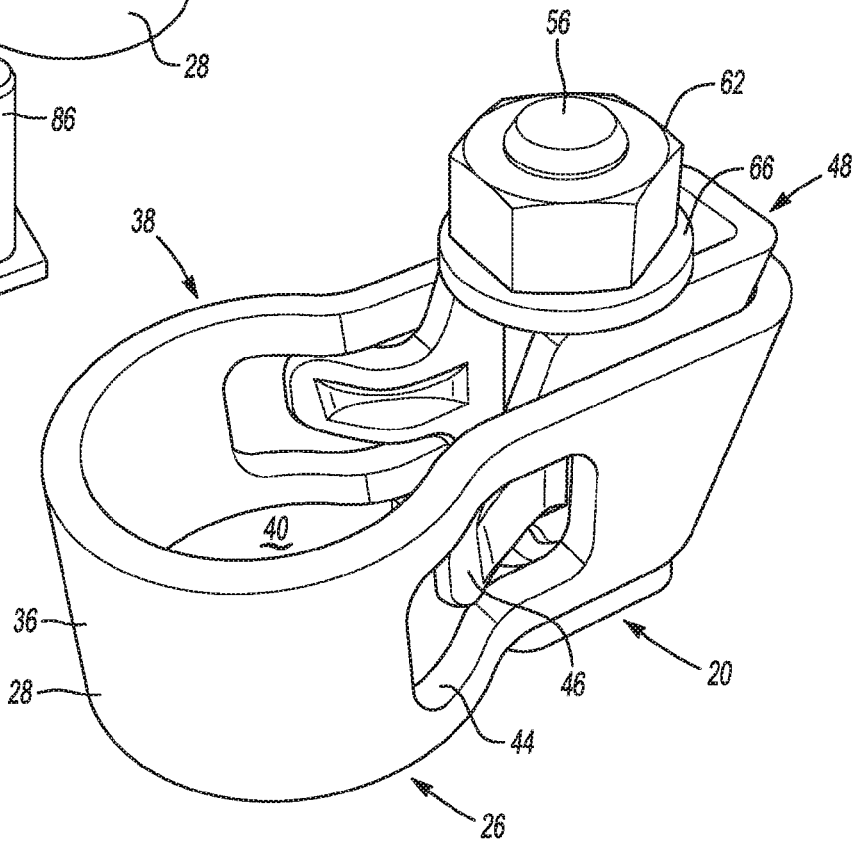
FIG. 2 is a perspective view of the mounting assembly of FIG. 1 in an assembled condition.
Figure 3:
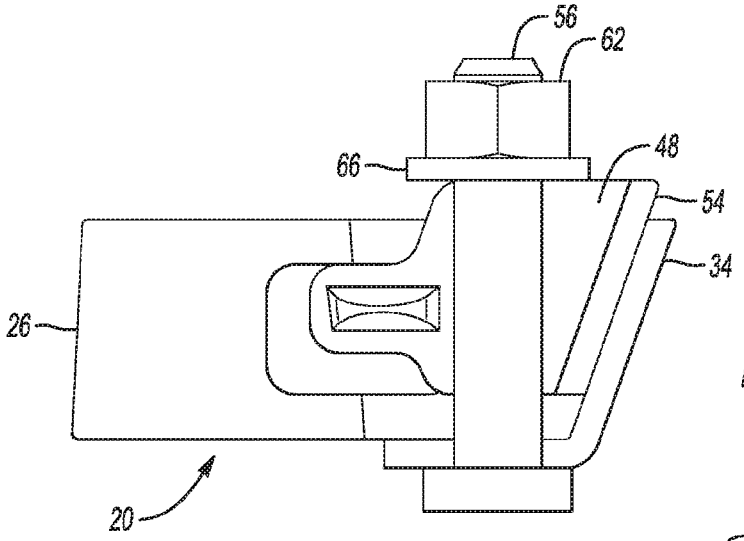
FIG. 3 is a side sectional view of the mounting assembly in an unengaged position.
Figure 4:
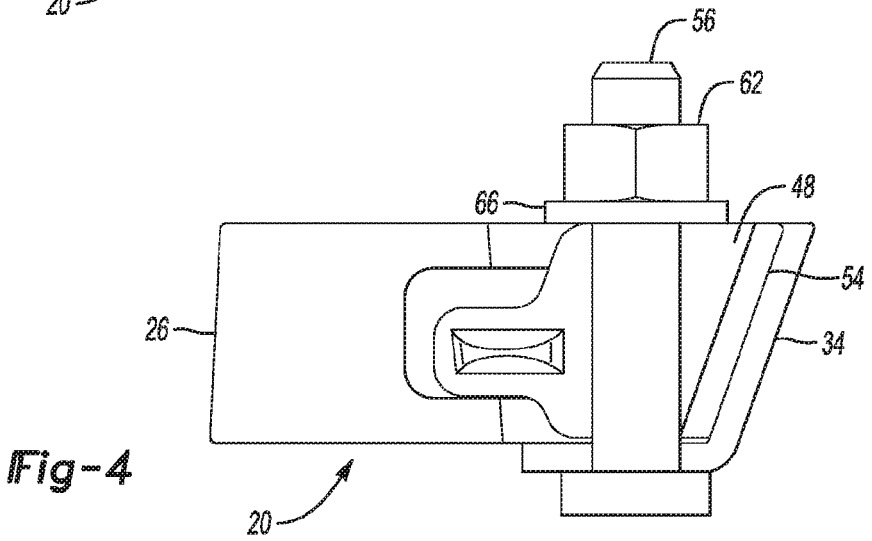
FIG. 4 is a side sectional view of the mounting assembly in an engaged position.

Referring to FIG. 1, a post attachment structure 26 includes a contact portion 28 formed with a wedge translation portion 30. In one aspect, the contact portion 28 is shaped to surround the terminal post 24 of the battery 22. The wedge translation portion 30 includes opposing walls 32 that are joined by an angled slide surface 34. In one aspect, the contact portion 28 may be monolithically formed with the wedge translation portion 30.

In one aspect, the contact portion 28 may include a ring shaped wall 36 having an open top and bottom 38, 40. The ring shaped wall 36 may include a neck 42 that transitions to the wedge translation portion 30. The neck 42 may include cut out slots 44 formed therein that accommodate terminal contacts 46, as will be discussed in more detail below.

The mounting assembly 20 also includes an internal wedge 48 that is positioned within the post attachment structure 26. The internal wedge 48 includes an u-shaped body 50 having opposing side walls 52 coupled by an angled wall 54. The opposing side walls 52 include terminal contacts 46 extending therefrom. The mounting assembly 20 also includes a core bolt 56 that is rotationally fixed and extends through the post attachment structure 26 and into a cavity 58 defined by the separated opposing side walls 52 of the internal wedge 48. In one aspect, the core bolt 56 may be rotationally fixed by securing a head 60 of the core bolt 56 such that it cannot spin or rotate, as will be discussed in more detail below.

A nut 62 is threaded on the core bolt 56 and may contact an upper edge 64 of the internal wedge 48. A washer 66 may be positioned about the core bolt 56 with the nut 62 contacting the washer 66 which in turn contacts the upper edge 64 of the internal wedge 48. The outer surface of the angled wall 54 of the internal wedge 48 engages the angled slide surface 34 of the post attachment structure 26 such that rotation of the nut 62 imparts a downward force 70 on the internal wedge 48 wherein contact of the angled wall 54 and the slide surface 34 evenly translates the downward force 70 to a horizontal force 72 moving the terminal contacts 46 into engagement with the terminal post 24.

In one aspect, the angle of the angled wall 54 of the internal wedge 48 and the angled slide surface 34 may be from 15 to 25 degrees as measured from a vertical axis. The angle of the components when in the unengaged state may allow for a vertical translation of the nut resulting in a horizontal translation of the contacts such that they securely and evenly engage the terminal post 24.

Figure 5:
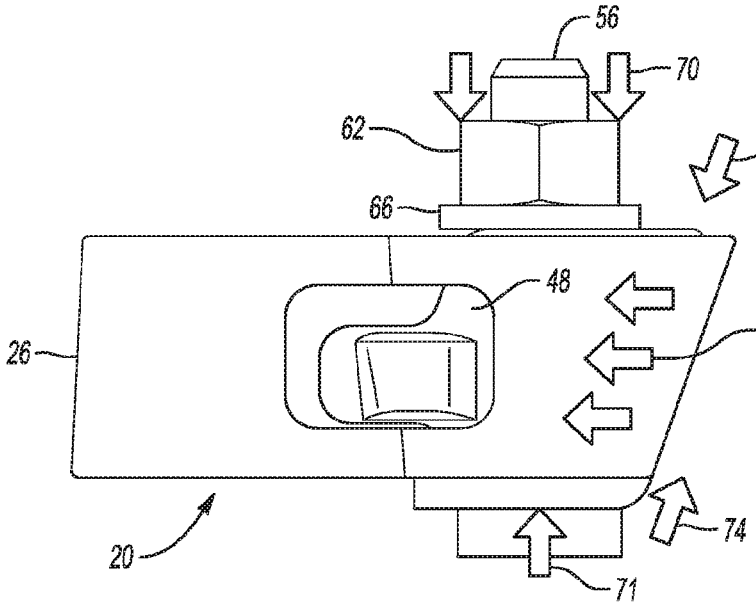
FIG. 5 is a side view detailing forces applied between the post attachment structure, internal wedge, core bolt and nut.

Referring to FIG. 5, there is shown the translation of the forces including the downward force 70 as well as the opposing upward force 71 associated with the core bolt 56 and nut 62. Additionally, there is shown the sliding forces 74, 76 applied between the internal wedge 48 and post attachment structure 26. Further, as depicted, the horizontal force 72 is evenly applied to the terminal contacts 46 for securely engaging the mounting assembly 20 about a terminal post 24 of a battery 22.

Again referring to FIGS. 1 and 2, the wedge translation portion 30 includes an open top and a bottom surface 78 having a slot 80 formed therein that receives the core bolt 56. The terminal contacts 46 may include a curved body 82 that extends outward relative to the opposing side walls 52 of the internal wedge 48. In one aspect, the curved bodies 82 define a variable engagement diameter with the terminal post 24. Such an engagement diameter may accommodate various post sizes of batteries such that when in the unengaged position the internal wedge allows easy assembly of the post attachment structure about the battery terminal post and also may allow engagement of the terminal contacts with various terminal post sizes.

Figure 6:
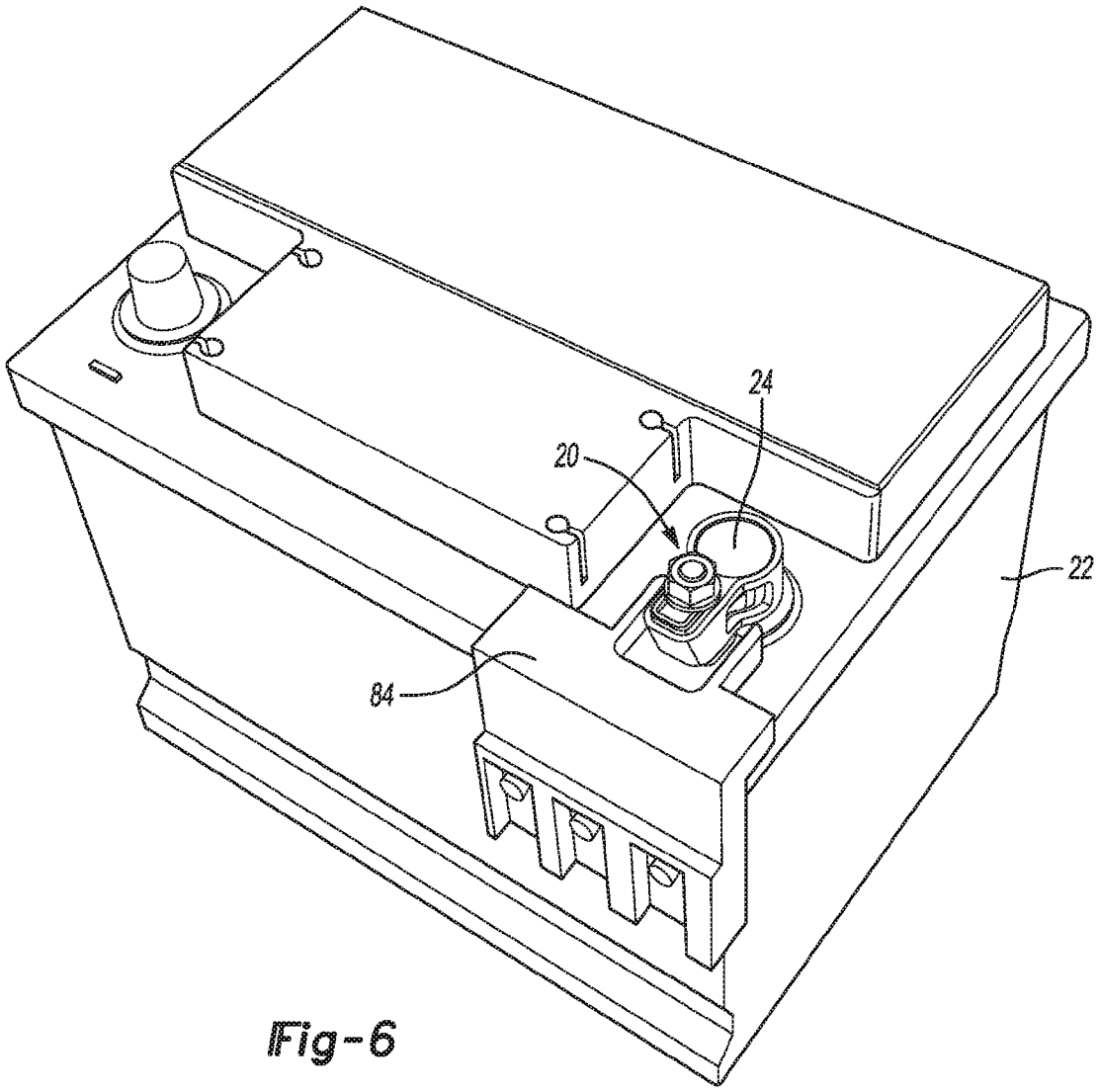
FIG. 6 is a perspective view of the mounting assembly coupled to a battery and further including a battery electrical component.
Figure 7:
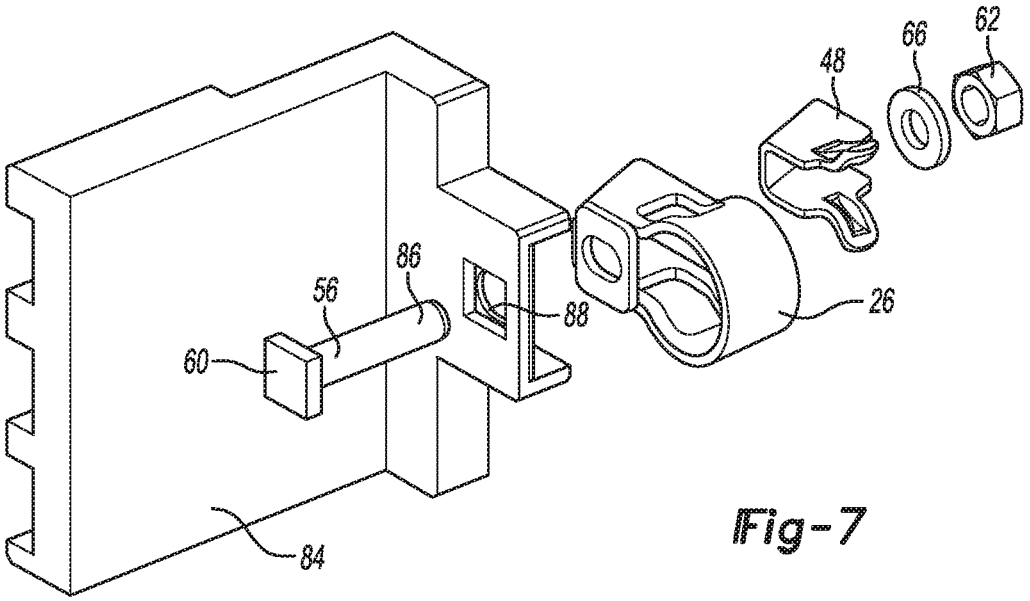
FIG. 7 is an exploded perspective view of the mounting assembly and a battery electrical component.
Figure 8:
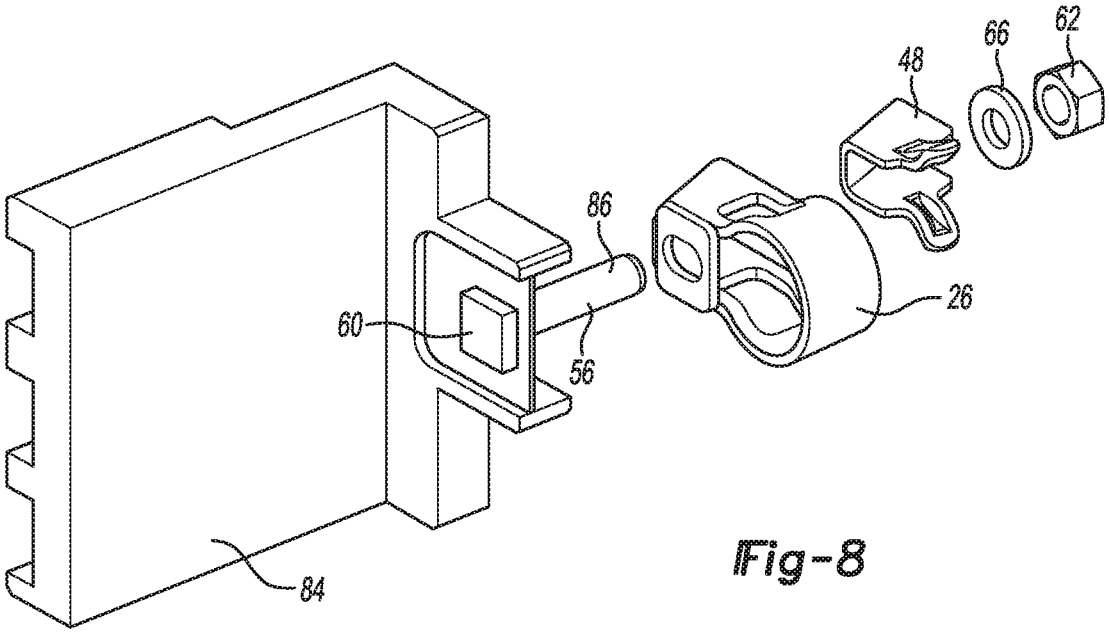
FIG. 8 is an exploded perspective view of the mounting assembly and an additional battery electrical component.

Referring to FIGS. 6-8, there is depicted an additional battery electrical component 84 positioned on the battery 22. In one aspect, the additional battery electrical component 84 may be a battery fuser terminal to allow additional wire harnesses to be coupled to the battery from a single terminal mounting assembly 20. In one aspect, the core bolt 56 may be rotationally fixed by the additional battery electrical component 84. Referring to FIG. 7, there is shown one version of an additional electrical component 84 wherein the core bolt 56 includes a head 60 having a threaded shaft 86 that extends therefrom for engaging the nut 62. The battery electrical component 84 includes a cavity with a through hole 88 formed therein with the threaded shaft 86 extending through the cavity with a through hole 88 and the head 60 of the core bolt 56 is positioned in the cavity with a through hole 88 and is rotatively restrained or fixed preventing rotation of the core bolt 56.

Referring to FIG. 8, there is shown an additional battery component where the core bolt 56 includes a head 60 having a threaded shaft 86 that extends therefrom for engaging the nut 62. In the depicted embodiment, the battery electrical component 84 is joined to the head 60 of the core bolt 56 again preventing rotation or restraining the core bolt rotatively. Various methods and structures may be used to fix the head 60 of the core bolt 56 onto the additional electrical component 84. For example, the core bolt 56 may be press fit, welded or molded with the additional component 84 to permanently fix the core bolt 56 rotatively.

Figure 9:
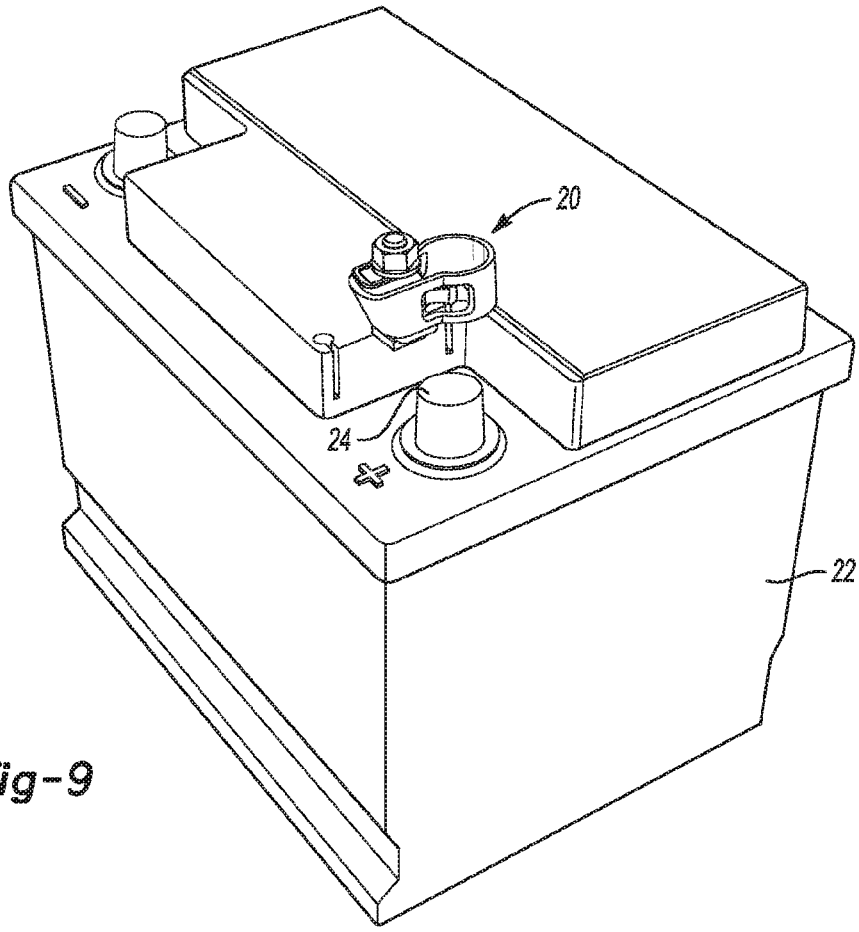
FIG. 9 is a perspective view of a battery and mounting assembly prior to positioning around a battery terminal post.
Figure 10:
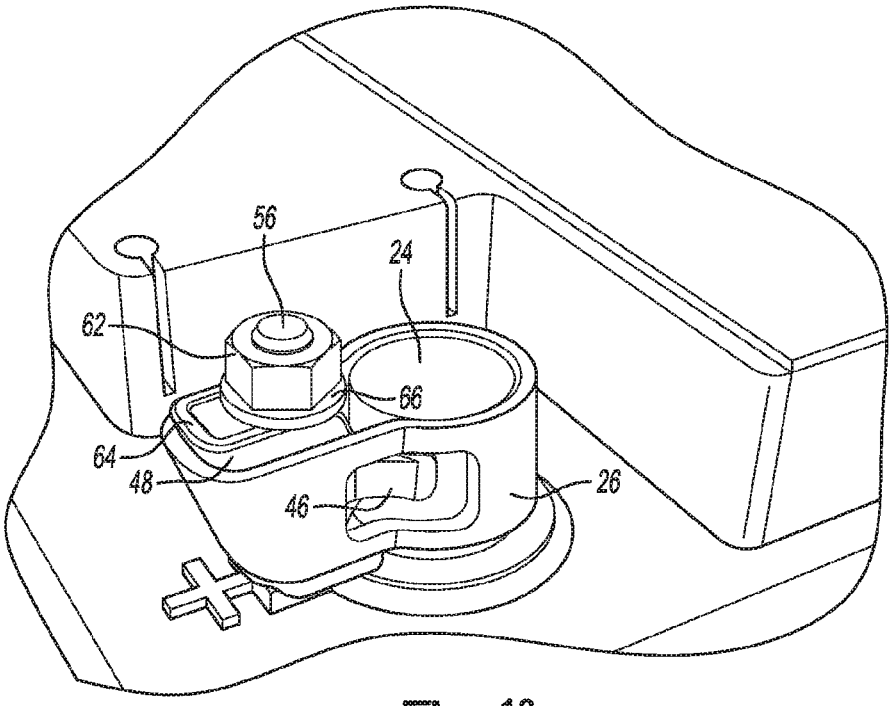
FIG. 10 is a partial perspective view of the mounting assembly positioned about a battery terminal post with the internal wedge in an unengaged position.

Referring to FIGS. 9-12, operation and attachment of the mounting assembly 20 will be described. Referring to FIGS. 9 and 10, the internal wedge 48 is positioned within the post attachment structure 26 with the core bolt 56 passing through the post attachment structure 26 and the internal wedge 48. The nut 62 is threaded on the core bolt 56 and contacts an upper edge 64 of the internal wedge 48. In this state the internal wedge 48 is in an unengaged position such that the post attachment structure 26 may be fitted about the terminal post 24 of the battery 22 and the terminal contacts 46 are not in engagement with the terminal post 24.

Figure 11:
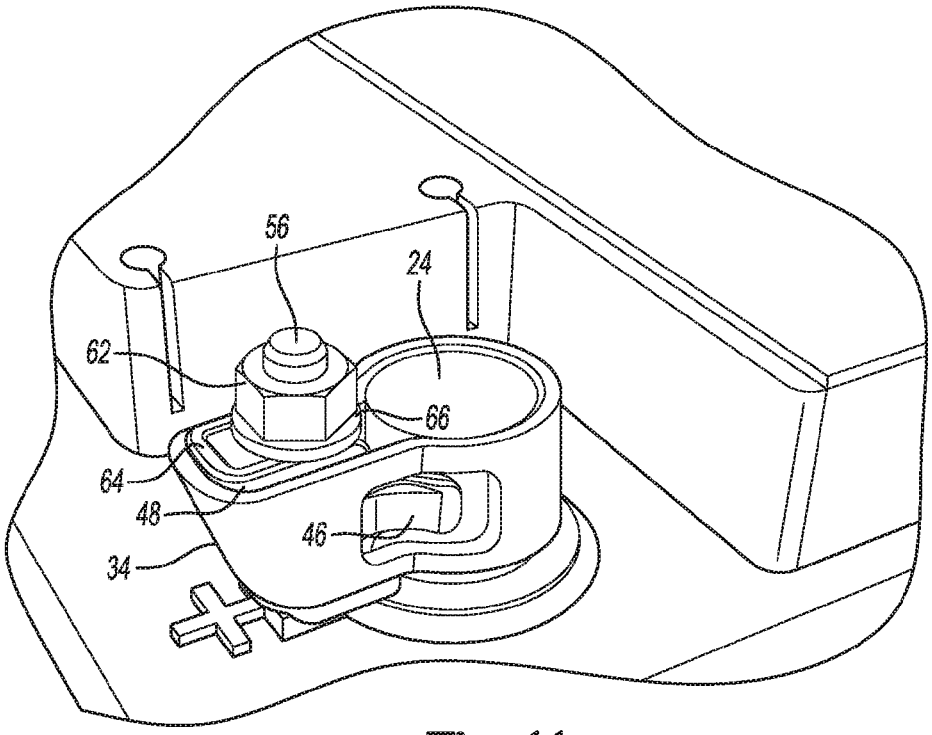
FIG. 11 is a partial perspective view of the mounting assembly positioned about a battery terminal post with the internal wedge being moved towards an engaged position.
Figure 12:
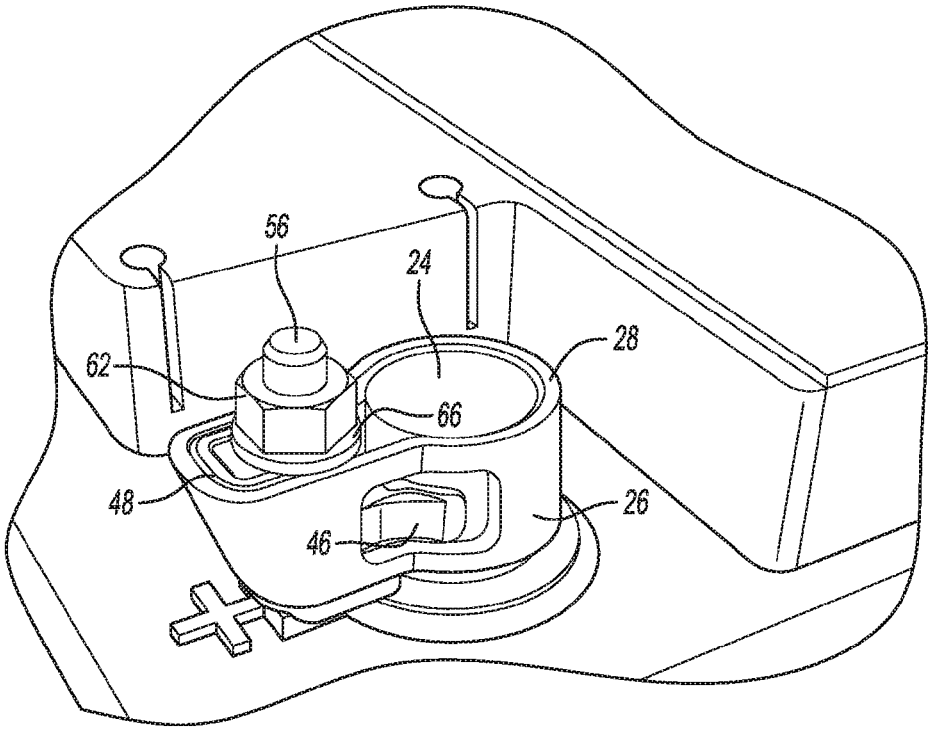
FIG. 12 is a partial perspective view of the mounting assembly positioned about a battery terminal post with the internal wedge in an engaged position.

Referring to FIGS. 11 and 12, the nut 62 may be tightened on the core bolt 56 such that a downward force is applied to the internal wedge 48 where contact of the angled wall 54 and the slide surface 34 evenly translates the downward force 70 to a horizontal force 72 moving the terminal contacts 46 toward an engagement with the terminal post 24. Continued rotation of the nut 62 applies a downward force on the internal wedge 48 with continued movement horizontally of the terminal contacts 46 until it is in an engaged position with the terminal post 24. In the engaged position, the terminal contacts 46 engage the terminal post 24 on a portion of a terminal post and the contact portion 28 of the post attachment structure 26 surrounds an additional portion of the terminal post 24. In the engaged position, an even force is applied to the terminal contacts 46 securely retaining the mounting assembly 20 with the terminal post 24.

I claim:

1. A vertical mounted battery terminal mounting assembly for attaching to a battery terminal comprising:

a battery having a terminal post;

a post attachment structure including a contact portion formed with a wedge translation portion, the contact portion shaped to surround the terminal post of the battery, the wedge translation portion including opposing walls joined by an angled slide surface;

an internal wedge positioned within the post attachment structure, the internal wedge including a u-shaped body having opposing side walls coupled by an angled wall, the opposing side walls including terminal contacts extending therefrom;

a core bolt rotationally fixed and extending through the post attachment structure and extending in a cavity defined by the separated opposing side walls of the internal wedge;

a nut threaded on the core bolt and contacting an upper edge of the internal wedge wherein the angled wall of the internal wedge engages the angled slide surface of the post attachment structure wherein rotation of the nut imparts a downward force on the internal wedge wherein contact of the angled wall and the slide surface evenly translates the downward force to a horizontal force moving the terminal contacts into engagement with the terminal post.

2. The vertical mounted battery terminal mounting assembly of claim 1 wherein the contact portion is monolithically formed with the wedge translation portion.

3. The vertical mounted battery terminal mounting assembly of claim 1 wherein the contact portion includes a ring shaped wall having an open top and bottom, the ring shaped wall including a neck transitioning to the wedge translation portion.

4. The vertical mounted battery terminal mounting assembly of claim 3 wherein the neck includes cut out slots formed therein accommodating the terminal contacts.

5. The vertical mounted battery terminal mounting assembly of claim 1 wherein the wedge translation portion includes an open top and a bottom surface having a slot formed therein receiving the core bolt.

6. The vertical mounted battery terminal mounting assembly of claim 1 wherein the terminal contacts include a curved body extending outward relative to the opposing side walls.

7. The vertical mounted battery terminal mounting assembly of claim 6 wherein the curved bodies define a variable engagement radius.

8. The vertical mounted battery terminal mounting assembly of claim 1 including a washer positioned about the core bolt and contacting the upper edge of the internal wedge.

9. The vertical mounted battery terminal mounting assembly of claim 1 further including a battery electrical component positioned on the battery, the core bolt being rotationally fixed by the battery electrical component.

10. The vertical mounted battery terminal mounting assembly of claim 9 wherein the core bolt includes a head portion having a threaded shaft extending therefrom for engaging the nut and wherein the battery electrical component includes a cavity with a through hole formed therein, the threaded shaft extending through the through hole and the head of the core bolt positioned in the cavity and rotatively restrained.

11. The vertical mounted battery terminal mounting assembly of claim 9 wherein the core bolt includes a head portion having a threaded shaft extending therefrom for engaging the nut and wherein the battery electrical component is joined to the head of the core bolt rotatively restraining the core bolt.

12. A vertical mounted battery terminal mounting assembly for attaching to a battery terminal comprising:

a battery having a terminal post;

a post attachment structure including a contact portion shaped to engage the terminal post of the battery, the post attachment structure including a wedge translation portion including an angled slide surface;

an internal wedge positioned within the post attachment structure, the internal wedge including an angled wall and terminal contacts;

a core bolt rotationally fixed and extending through the post attachment structure and the internal wedge;

a nut threaded on the core bolt and contacting an upper edge of the internal wedge wherein the angled wall of the internal wedge engages the angled slide surface of the post attachment structure wherein rotation of the nut imparts a downward force on the internal wedge wherein contact of the angled wall and the slide surface evenly translates the downward force to a horizontal force wherein the terminal contacts and contact portion engage the battery terminal.

13. The vertical mounted battery terminal mounting assembly of claim 12 wherein the wedge translation portion includes opposing walls joined by the angled slide surface.

14. The vertical mounted battery terminal mounting assembly of claim 12 wherein the internal wedge includes a u-shaped body having opposing side walls coupled by the angled wall, the opposing walls including the terminal contacts extending therefrom.

15. The vertical mounted battery terminal mounting assembly of claim 12 wherein the contact portion includes a ring shaped wall having an open top and bottom, the ring shaped wall including a neck transitioning to the wedge translation portion and wherein the neck includes cut out slots formed therein accommodating the terminal contacts.

16. The vertical mounted battery terminal mounting assembly of claim 14 wherein the terminal contacts include a curved body extending outward relative to the opposing side walls and wherein the curved bodies define a variable engagement radius.

17. The vertical mounted battery terminal mounting assembly of claim 12 further including a battery electrical component positioned on the battery, the core bolt being rotationally fixed by the battery electrical component.

18. The vertical mounted battery terminal mounting assembly of claim 17 wherein the core bolt includes a head portion having a threaded shaft extending therefrom for engaging the nut and wherein the battery electrical component includes a cavity with a through hole formed therein, the threaded shaft extending through the through hole and the head of the core bolt positioned in the cavity and rotatively restrained.

19. The vertical mounted battery terminal mounting assembly of claim 17 wherein the core bolt includes a head portion having a threaded shaft extending therefrom for engaging the nut and wherein the battery electrical component is joined to the head of the core bolt rotatively restraining the core bolt.

20. A vertical mounted battery terminal mounting assembly for attaching to a battery terminal comprising:

a battery having a terminal post;

a post attachment structure including a contact portion formed with a wedge translation portion, the contact portion shaped to surround the terminal of the battery, the wedge translation portion including opposing walls joined by an angled slide surface;

an internal wedge positioned within the post attachment structure, the internal wedge including a u-shaped body having opposing side walls coupled by an angled wall, the opposing walls including terminal contacts extending therefrom;

a battery electrical component positioned on the battery, the core bolt being rotationally fixed by the battery electrical component, the core bolt extending through the post attachment structure and extending in a cavity defined by the separated opposing side walls of the internal wedge;

a nut threaded on the core bolt and contacting an upper edge of the internal wedge wherein the angled wall of the internal wedge engages the angled slide surface of the post attachment structure wherein rotation of the nut imparts a downward force on the internal wedge wherein contact of the angled wall and the slide surface evenly translates the downward force to a horizontal force moving the terminal contacts into engagement with a battery terminal.

* * * * *